US006142069A

United States Patent [19]

Eitel et al.

[11] Patent Number: 6,142,069

[45] Date of Patent: Nov. 7, 2000

[54] DEVICES AND METHOD FOR CONVEYANCE OF SHEETS

[75] Inventors: Johann Emil Eitel, Thungen; Johannes Georg Schaede, Wurzburg, both of Germany

[73] Assignee: De La Rue Giori S.A., Lausanne, Switzerland

[21] Appl. No.: 09/142,920

[22] PCT Filed: Mar. 14, 1997

[86] PCT No.: PCT/DE97/00521

§ 371 Date: Sep. 17, 1998

§ 102(e) Date: Sep. 17, 1998

[87] PCT Pub. No.: WO97/35794

PCT Pub. Date: Oct. 2, 1997

[30] Foreign Application Priority Data

Mar. 23, 1996 [DE] Germany ..... 196 11 560

[51] Int. Cl.[7] ..... B41F 1/07

[52] U.S. Cl. ..... 101/25; 101/488; 101/35

[58] Field of Search ..... 101/8, 9, 18, 21, 101/22, 25, 27, 31, 33, 35, 37, DIG. 31, 212, 216, 232, 477, 479, 488, 181, 183, 228

[56] References Cited

U.S. PATENT DOCUMENTS

| | | | |
|---|---|---|---|
| 1,870,117 | 8/1932 | Henderson | 101/232 |
| 2,248,419 | 7/1941 | Auld | 101/DIG. 31 |
| 3,125,950 | 3/1964 | Ayers | 101/212 |
| 3,208,898 | 9/1965 | Chavannes et al. | 101/32 |
| 3,847,077 | 11/1974 | Zirnstein et al. | 101/183 |
| 4,104,965 | 8/1978 | Abe | 101/25 |
| 4,475,457 | 10/1984 | Davison | 101/228 |
| 4,515,079 | 5/1985 | Dahlgren | 101/232 |
| 5,186,103 | 2/1993 | Gelinas et al. | 101/181 |
| 5,606,913 | 3/1997 | Kowalewski | 101/232 |

FOREIGN PATENT DOCUMENTS

| | | | |
|---|---|---|---|
| 1 288 016 | 1/1969 | Germany . | |
| 30 20 847 | 1/1981 | Germany . | |
| 29 31 194 | 2/1981 | Germany . | |
| 0138648 | 8/1983 | Japan | 101/31 |
| 0250955 | 12/1985 | Japan | 101/181 |
| 677 338 | 5/1991 | Switzerland . | |
| 2 008 032 | 5/1979 | United Kingdom . | |

*Primary Examiner*—Eugene Eickholt
*Attorney, Agent, or Firm*—Pitney, Hardin, Kipp & Szuch, LLP

[57] ABSTRACT

A device for conveying sheets in a sheet-processing machine uses a processing cylinder having a circumferential speed. Conveyor belts cooperate with the cylinder for transporting sheets with the belts arranged between the processing cylinder and a chain conveyor with a gripper system. A ratio between the transportation speed of the processing cylinder can be changed by use of a drive of the conveyor belts in order to vary the distance between successive sheets.

10 Claims, 2 Drawing Sheets

DEVICES AND METHOD FOR CONVEYANCE OF SHEETS

DESCRIPTION

Devices and method for conveyance of sheets.

The invention relates to a method and devices in accordance with the preamble of claims 1, 2, 3 and 8.

The WO 94/18103 discloses a machine for processing sheets with a pair of laminating rollers and a cutting cylinder, with conveyor belts. In this machine, neither the laminating rollers nor the cutting cylinder may be exchanged. In order to be adjusted to the length of a sheet, the cutting cylinder is driven with a variable speed. The transporting speed of the conveyor belts is constant with respect to the speed of the pair of laminating rollers.

The drawback in this case is that the circumferential speed of the pair of laminating rollers and of the conveyor belts may not be varied one in respect to the other, in order for example to compensate for changes in the thickness of the foil.

The usable circumferential surface of the laminating roller may neither be adjusted to the length of sheets.

One main drawback is the fact that after the pair of laminating rollers, the sheets are not displaced by moving transporting means.

The invention is based on the object of providing a method and devices for conveying sheets.

The DE 29 31 194 A1 discloses a hot stamping machine for a material packaging band.

This object is achieved according to the invention by means of a method and devices having the features of the characterizing parts of claims 1, 2, 3 and 8.

Advantageously, the method and devices according to the invention allow sheets which are to be processed on a processing cylinder to be processed in close succession. Even with changing format lengths of the sheets which are to be processed, it is possible, by means of exchangeable processing cylinders of different diameters, to keep a spacing between two successive sheets to a minimum. Particularly in the case of foil-stamping machines with a continuous supply of an endless foil for applying patterns to sheets, it is important for the distance between two successive sheets to be made as small as possible, in order to ensure that the foil is well utilized.

A flow of sheets which is supplied, for example, in the form of a stream is advantageously adapted by means of a suction drum. If it is necessary to change a ratio from a first spacing between successive sheets to a second spacing between successive sheets, e.g. in the case of different format lengths, this is possible as a result of simply preselecting corresponding laws of motion of appropriate software of an individual drive, e.g. of a servomotor. Suction drums are particularly suitable for this purpose, since, in contrast to drums provided with gripper systems, they are able to take hold of and release a sheet in any position, thus allowing favorable movement sequences. Moreover, it is advantageous that in order to adapt the device to a format length it is only necessary to exchange the processing cylinder. A downstream cooling roller or a delivery, for example, remain unchanged, as do conveyor belts connected between them. Just the speeds of the cooling roller, conveyor belts and of the suction rollers are adjustable with respect to one another. In this case, extremely fine adjustment of the conveying speed is possible in particular for the conveyor belts, in order to be able to adjust them to even the slightest changes in the speed at which the sheets are conveyed owing, for example, to paper quality, sheet thickness or the type of processing. In a particularly simple manner, this adaptation is effected by means of software-controlled individual drives.

Advantageously, the processing cylinder can be exchanged, since it is provided with running rolls arranged on its bearing plates. By means of these running rolls, the processing cylinder is displaced axially, in order to be exchanged, in guides which are fixed to the frame and moved onto a conveyor carriage. This operation takes place without further accessories, such as for example a crane, and without having to exert much force.

The processing cylinder is provided with suction strips, so that there is only a minimal passage which is not available for processing.

Furthermore, it is advantageously possible to use a sheet delivery with chain gripper systems which is known per se, since the spacing between two successive sheets is increased, following processing, to a spacing which is required for the chain gripper systems.

The sheet-processing machine can be adapted in a simple manner to different format lengths of the sheets to be processed.

The method and device according to the invention reduce the consumption of material, e.g. of an expensive hot-stamping foil.

The down times required to exchange a processing cylinder and the adaptation of sheet-conveying means which interact with this cylinder are reduced considerably.

The methods according to the invention and the device are described in more detail below and are illustrated in the drawing, in which.

Figure 1:
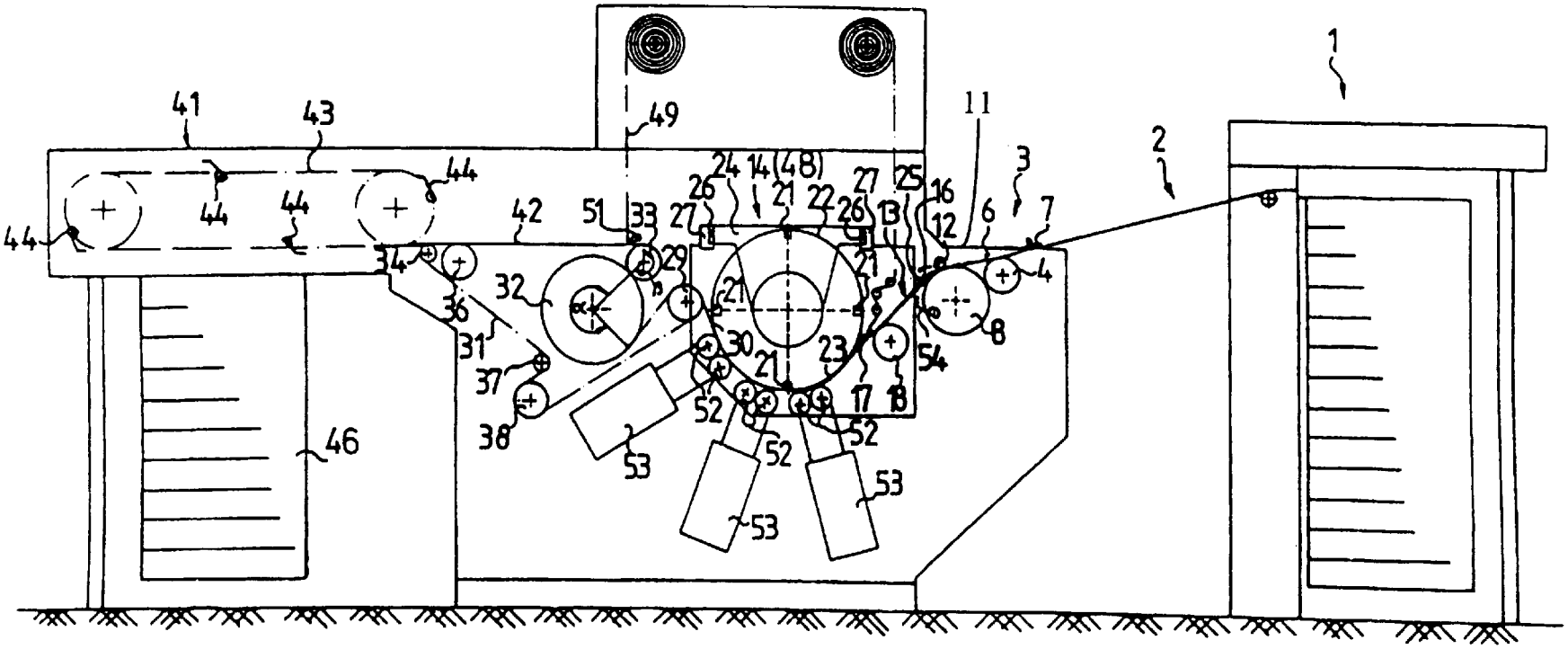
FIG. 1 shows a diagrammatic side view of a sheet-processing machine.
Figure 2:
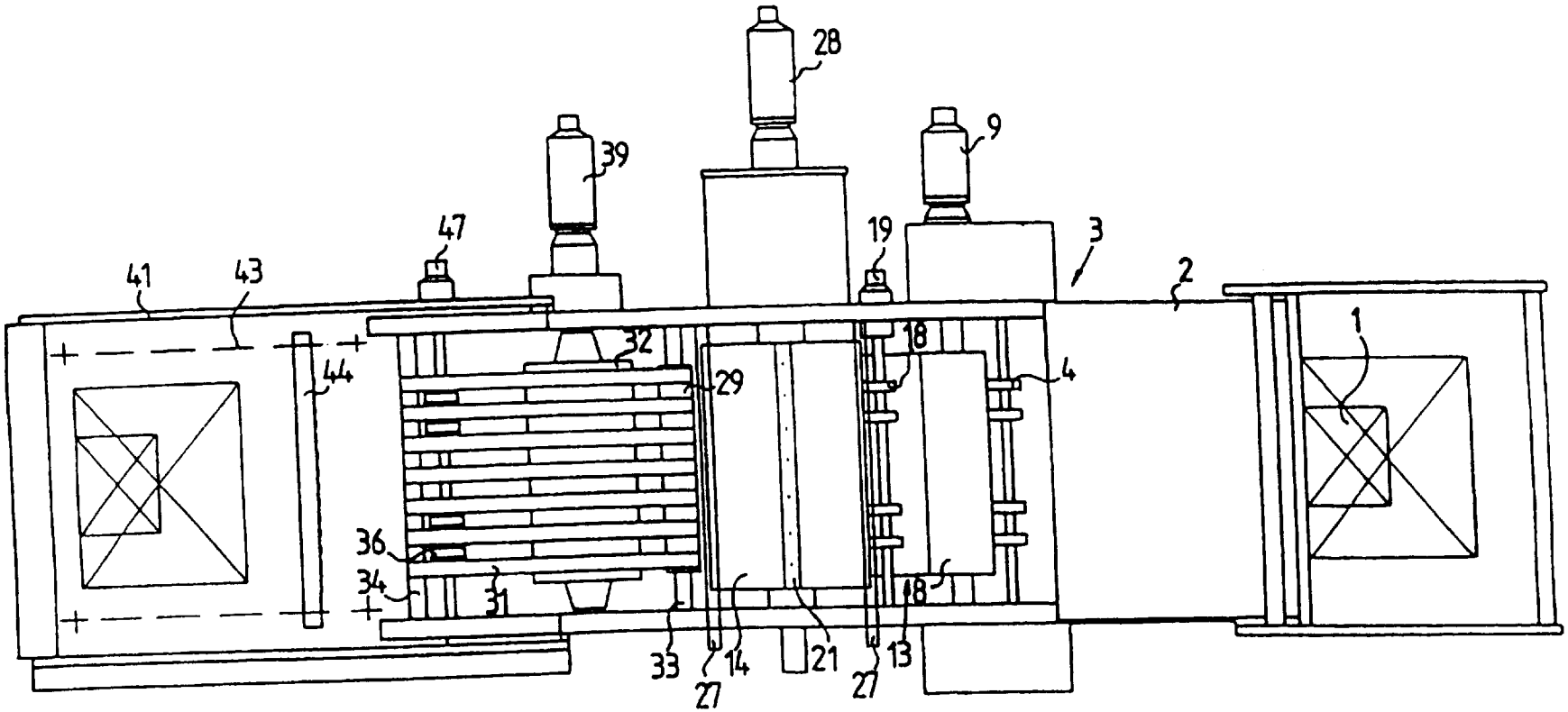
FIG. 2 shows a diagrammatic plan view of the sheet-processing machine.

A stream feeder 1, which is connected upstream of a sheet-processing machine, is provided with a creeper table 2 which leads to a sheet feed guide 3. The sheet feed guide 3 essentially comprises a first suction drum 4, advance alignment marks 6, a side pull-type mark 7 and a transfer drum 8. In the present exemplary embodiment, stream feeder 1 and sheet feed guide 3 have a common drive 9, e.g. a speed-controllable and/or position-controllable electric motor. This drive 9 drives the transfer drum 8 steadily, so that the transfer drum 8 has a fixable circumferential speed u8, e.g. u8=2.44 m/s. This circumferential speed u8 of the transfer drum 8 corresponds to a machine speed $u_m$ of the sheet-processing machine. Starting from the transfer drum 8, the suction drum 4 is driven nonuniformly by means of a transmission, e.g. a step-by-step motion linkage, in such a manner that it is alternately accelerated from standstill to a circumferential speed u4 which is slightly higher than the machine speed u,, of the sheet-processing machine and is then decelerated back to standstill. The suction drum 4 can also be driven by means of a dedicated, independent electric motor, the rotational speed and/or angle of rotation of which can then be controlled in accordance with predetermined laws of motion.

Downstream of this suction drum 4—as seen in the conveying direction—there is arranged a guide plate 11 which is aligned tangentially with respect to transfer drum 8 and suction drum 4 and leads to the transfer drum 8. Advance alignment marks 6 are arranged in this guide plate 11 parallel to the transfer drum 8, such that they can be pivoted out of a sheet-conveying plane, beneath the guide plate 11. Downstream of this first guide plate 11, a plurality of sheet-guidance rolls 12 are provided on the transfer drum 8. These sheet-guidance rolls 12 are arranged axially parallel with respect to the transfer drum 8 and can be placed in frictional engagement against the latter. A second guide plate 13 leads from the transfer drum 8 to a processing cylinder 14 of the sheet-processing machine. This guide plate 13 comprises two partial pieces 16, 17, the first partial piece 16 again being aligned tangentially with respect to the transfer drum 8. The second partial piece 17 is arranged pivotably with respect to an end, lying closest to the processing cylinder 14, of the first partial piece 16, so that an end, facing toward the processing cylinder 14, of the second partial piece 17 of the guide plate 13 can be moved into the immediate vicinity of the processing cylinder 14, aligned approximately tangentially with respect to the latter. The position of the second partial piece 17 of guide plate 13 can be adapted to processing cylinders 14 of different sizes. For this purpose, in the present example, the partial piece 17 is mounted pivotably in side frames and is pressed resiliently, for example by means of pneumatic cylinders, against the processing cylinder 14. A second suction drum 18, which can move with the second partial piece 17 of the guide plate 13, is arranged beneath this guide plate 13, i.e. the position of the suction drum 18 can be adapted to the diameter D14 of the processing cylinder. This second suction drum 18 has a dedicated speed-controllable and/or position-controllable drive 19. For this purpose, an electric motor is provided, the rotational speed and/or angle of rotation of which can be adjusted according to predeterminable laws of motion. With this drive 19, a circumferential speed u18 of the suction drum 18 is controlled in such a way that this drum initially is at machine speed $u_m$, is then decelerated to a lower circumferential speed u18' and is then accelerated back to machine speed $u_m$ ($u_m$/u18'=1.1 to 3). This lower circumferential speed u18' is only slightly greater than a circumferential speed u14 of the processing cylinder 14, e.g. u18'/u14=1.05 to 1.3. At a constant machine speed $u_m$, the circumferential speed u18' can be adapted to the particular circumferential speed u14 of the processing cylinder 14, which arises as a result of the use of various processing cylinders 14 of different diameters. The circumferential speed u18 of the suction drum 18 is continuously variable within a range of the ratio of the machine speed $u_m$ to the lower circumferential speed u18' of the suction drum 18, e.g. $u_m$/u18'=1.1 to 3, i.e. the ratio of this speed is adjustable based on the number of sheets to be processed (processing cycle) per unit time. The suction drum 18 can also be driven, for example, by means of a cam drive which produces a nonuniform movement. Instead of the two suction drums 4, 18 and the transfer drum 8, it is also possible, by way of example, for only a single conveyor device, which is designed, for example, as a suction drum, to be provided, which conveyor device transfers a sheet from the creeper table directly to the processing cylinder 14. For this purpose, the sheet to be transferred is accelerated from a standstill to a speed which is slightly higher than the circumferential speed u14 of the processing cylinder 14. In this case too, the speed prevailing during transfer of the sheet onto the processing cylinder 14 is then adjustable, i.e. the ratio of this speed with respect to the number of sheets to be processed (processing cycle) per unit time is adjustable.

This processing cylinder 14 has a diameter D14 of, for example, 606 mm and is provided with four holding systems 21, for example suction strips 21, which extend in the axial direction and are distributed uniformly over the circumference. In the circumferential direction of the processing cylinder 14, these suction strips 21 have only a small width b21, e.g. b21=25 mm. Front marks for aligning the sheets 23 on the processing cylinder 14 are arranged upstream of the respective suction strips 21. An otherwise continuous circumferential surface 22 of the processing cylinder 14 is interrupted only by these suction strips 21 and front marks which are arranged directly ahead of the suction strips 21. These front marks are arranged to run parallel to the suction strips 21 and have a thickness, for example, of 3 to 4 mm. The diameter D14, e.g. 606 mm, and/or the circumference u14, e.g. 1904 mm, of the processing cylinder 14 is adapted to a length 123, e.g. 123 =472 mm, of the sheets 23 to be processed, i.e. a length of the circumference between these the front marks corresponds to the length of the sheets 23 to be processed (circumference u14 of the processing cylinder 14 divided by the number of suction strips 21, minus the thickness of the front marks, results in the length 123 of the sheet 23 for optimum cylinder utilization). Suction air or compressed air is applied to these suction strips 21 in a controlled manner by means of a rotary introduction device. As in the present example, this processing cylinder 14 may be provided with four suction strips 21 and four corresponding segments of the circumferential surface 22. However, it is also possible to provide any other desired number of segments of the circumferential surface 22, in particular only three or five segments, with the corresponding number of suction strips 21. However, the holding systems 21 may also be provided with conventional grippers.

This processing cylinder 14 is arranged exchangeably, so that processing cylinders 14 having different lengths of the segments of the circumferential surface 22 can be used, i.e. processing cylinders 14 with different diameters D14, e.g. 504 mm to 672 mm. Processing cylinders 14 with diameters D14 of different sizes are to be understood as meaning that a working surface of the holding systems 21 is spaced apart at different radii from the axis of rotation. By exchanging the processing cylinder 14, the sheet-processing machine can be adapted to different lengths 123, e.g. 400 mm to 700 mm, of the sheets 23 to be processed.

In order to exchange the processing cylinder 14, the latter is provided with bearing plates 24 to which running rolls 26 are attached. These running rolls 26 are guided in the side frames mounted guides 27, for example two U-rails which face toward one another and run in the axial direction, so that the processing cylinder 14 can be removed from the processing machine in the axial direction. However, it is also possible to arrange the guides, for example, on a conveyor carriage and to introduce them into the sheet-processing machine only when required. When removing the processing cylinder 14 from the processing machine, the bearing plates 24 remain connected to the processing cylinder 14.

The processing cylinder 14 is driven at a uniform circumferential speed u14 which is synchronized with the machine speed $u_m$, a ratio between the circumferential speed u14 of the processing cylinder 14 and the machine speed $u_m$ being adjustable in accordance with the diameter D14 of the processing cylinder 14. In the present example, this is achieved by means of a dedicated drive 28, e.g. a speed-controllable and/or position-controllable electric motor 28. However, it is also possible to connect transfer drum 8 and processing cylinder 14 by means of a transmission of adjustable transmission ratio.

A guide plate 30 a first guide roller 29 of a system of conveyor belts 31 is arranged downstream of the processing cylinder 14. The position of this guide roller 29 and of the guide plate 30 can be adapted to the diameter D14 of the processing cylinder 14. A number of conveyor belts 31 which lie next to one another in the axial direction is guided around this guide roller 29. However, it is also possible to arrange only a single, wide conveyor belt 31. These conveyor belts 31 lead from this guide roller 29 to a cooling roller 32 and wrap around the latter over an angle alpha e.g. alpha=270°, after which a further guide roller 33 is arranged. The conveyor belts 31 wrap around the guide roller 33 over an angle beta, e.g. beta=235°, and move in an approximately horizontal direction toward a third guide roller 34. Just upstream of this third guide roller 34, a suction drum 36 is arranged beneath the conveyor belts 31 and between the conveyor belts 31, the circumferential surface of which suction drum is tangent upon the plane in which the sheets 23 are conveyed in this region. This suction drum 36 may also be arranged directly downstream of the conveyor belts 31.

A box to which suction air can optionally be applied is arranged beneath the perforated conveyor belts 31, between the second guide roller 33 and the third guide roller 34. On its side which interacts with the perforated conveyor belts 31, this box also has openings. From this third guide roller 34, the conveyor belts 31 are returned, via a deflection roller 37 and a fourth guide roller 38, to the first guide roller 29. When adapting the position of the guide roller 29, it is necessary for a "length compensation" of the conveyor belts 31 to take place. For this purpose, by way of example, the guide roller 38 is mounted movably.

A circumferential speed u32 of the cooling roller 32 and a conveying speed v31 of the conveyor belts 31 is approximately equal to the circumferential speed u14 of the processing cylinder 14. The circumferential speed u14 with respect to a processing cycle per unit time of the processing cylinder 14, which is, for example, exchangeable, is variable as a function of a particular diameter D14. The conveying speed v31 of the conveyor belts 31, i.e. of the cooling roller 32, can therefore be adapted to the circumferential speed u14 of the processing cylinder 14. Since changes in the sheets 23 to be conveyed (for example as a function of quality, thickness or nature of the preceding processing), in particular changes in length, leads to a change in the speed at which the sheets 23 are conveyed, the conveying speed v31 of the conveyor belts 31 is extremely finely adjustable, i.e. can be adapted to the circumferential speed u14 of the processing cylinder 14. For this purpose, in the present example, the cooling roller 32 is provided with a dedicated drive 39, e.g. a speed-controllable and/or position-controllable electric motor, which is synchronized with the processing cylinder 14, while the conveyor belts 31 are driven frictionally by the cooling roller 32. Instead of the dedicated drive 39 which is independent of the processing cylinder 14, it is also possible to provide a forced drive, for example starting from the processing cylinder 14, e.g. toothed gearing or belt gearing, an adjustment mechanism for, for example, the continuous adjustment of a transmission ratio being arranged between cooling roller 32 and processing cylinder 14.

The conveyor belts 31 are adjoined by a delivery 41 which is known per se. A guide plate 42 is arranged in the transition region between the conveyor belts 31 and the delivery 41. This delivery 41 is provided with a revolving chain conveyor, with a number of gripper systems 44 arranged at a spacing a44—with respect to the taut chain 43—attached to the two chains 43 of said chain conveyor. These gripper systems 44 are moved at a conveying speed v44 which is greater than the conveying speed v31 of the conveyor belts 31. This conveying speed v44 of the gripper systems 44 in the present example approximately corresponds to machine speed $u_m$. The gripper systems 44 deposit the sheets on a sheet pile 46 of the delivery 41.

The suction drum 36 has a dedicated speed-controllable and/or position-controllable drive 47 upstream of the delivery 41. For this purpose, an electric motor is provided, the speed of which can be adjusted in accordance with predeterminable laws of motion. By means of this drive 47, a circumferential speed u36 of the suction drum 36 is controlled in such a manner that the suction drum 36 is initially at the conveying speed v31 of the conveyor belts 31, is then accelerated to a speed which is slightly greater than the machine speed $u_{,,}$ and is then decelerated again in order, at the time of transfer to the chain gripper systems 44, to again be at, for example, machine speed $u_m$. The suction drum 36 is then decelerated further to conveying speed v31 of the conveyor belts 31. This "overspeed" is necessary in the present example in order to cover a necessary travel of the sheet 23 between suction drum 36 and gripper system 44. Naturally, the speed profile can be matched to the geometric conditions of the sheet-processing machine, the overspeed not being absolutely necessary in all cases.

In the case of this suction drum 36 too, the circumferential speed u36 is continuously variable within a range of a ratio between the conveying speed v31 at the moment of transfer of the sheets 23, 25 and the machine speed $u_m$ during the transfer of the sheets 23, 25 ($v31/u_m$=0.3 to 0.9). During the acceleration operation, the suction drum 36 moves the sheet 23 a required distance between suction drum 36 and gripper system 44. However, the suction drum 36 may also be moved by the drive 39 of the cooling roller 32, in that, by way of example, a cam drive producing a nonuniform movement is interconnected.

The circumferential speed of the suction drums 18, 36 is adjustable with respect to the machine speed $u_m'$. The laws of motion, e.g. the distance covered during one conveying operation of the sheet 23 taken hold of, can also be varied, for example by means of a position-controlled electric motor, e.g. as a function of sheet format and/or machine speed.

In the present example, the processing machine is designed as a foil-stamping machine. The processing cylinder 14 is in this case a stamping cylinder 48. In the present example, the stamping cylinder 48 is provided on its circumferential surface with stamping dies which are electrically heated. The power is supplied to the stamping dies on the stamping cylinder 48 by means of slip ring transformers which are flanged on at the end sides.

In the present example, a device which is not shown in more detail and is used for supplying and removing an endless substrate foil 49, e.g. a hot-stamping foil, is arranged above the stamping cylinder 48. The substrate foil 49 is guided to the stamping cylinder 48 by means of an unwinding station in the region of that partial piece 17 of the guide plate 13 which is close to the cylinder and, together with the sheets 23, is guided around the stamping cylinder 48. The substrate foil 49 is guided to the first guide roller 29 of the conveyor belts 31 and, from there, is guided together with the conveyor belts 31, around the cooling roller 32, to the second guide roller 33 of the conveyor belts 31. A foil-detachment device 51 is arranged downstream of this second guide roller 33. From this foil-detachment device 51, the substrate foil 49 is guided to a winding-up station.

A number of pressure rollers 52 which interact with the stamping cylinder 48 are arranged beneath the stamping cylinder 48. In the present example, in each case two rows of pressure rollers 52 which extend axially are pressed resiliently, by means of pneumatic cylinders 53, against the stamping cylinder 48. In total, in this example, three pairs of rows of these pressure rolls 52 are provided. A stroke of the pneumatic cylinders 53 is dimensioned in such a way that the pressure rolls 52 can be applied both to a largest possible stamping cylinder 48 and to a smallest possible stamping cylinder 48. The adjustment of guide plate 30 and of guide roller 29 can advantageously be coupled with the pneumatic cylinders 53.

As an alternative to using the processing machine as a foil-stamping machine, other usage purposes are also possible, e.g. the processing cylinder 14 can be used as a mating cylinder of a rotary sheet-printing press.

In addition, a single-sheet feeder may also be provided in stead of the stream feeder 1.

The processing machine according to the invention functions as follows:

The sheets 23 to be supplied are taken individually from a sheet pile 46 by means of the stream feeder 1 and are supplied to the processing machine in a stream via the creeper table 2 of the sheet feed guide 3. The sheets 23 are aligned in the circumferential direction at the advance alignment marks 6 which project out of the guide plate 11 and in the axial direction by the side pull-type mark 7. When the sheet 23 is aligned, suction air is applied to the suction drum 4 so that the latter takes hold of the sheet 23. The suction drum 4, together with the sheet 23 which it has taken hold of, is then accelerated from a standstill to the circumferential speed u4 which is slightly greater than the circumferential speed u8 of the transfer drum 8 and is thus conveyed to the transfer drum 8. After reaching the transfer drum 8, the sheet 23 is aligned in the circumferential direction at alignment marks and is taken hold of by a gripper system 54. The suction air to the suction drum 4 switched off. The gripper system 54 of the transfer drum 8 conveys the sheet 23 sheet 23 to the first guide plate 11 and is opened. In the meantime, the sheet-guidance rolls 12 have been placed on the transfer drum 8, and in this way the sheet 23 is guided in a clamped fashion. The sheet-guidance rolls 12 which interact with the circumferential surface of the transfer drum 8 then convey the sheet 23, at machine speed $u_m$, along the guide plate 13 to the suction drum 18. Successive sheets 23, 25 are at a spacing a1 of, for example, 408 mm between an end of the leading sheet 23 and a beginning of the trailing sheet 25. On reaching the suction drum 18 which is rotating at machine speed $u_m$, suction air is applied to this suction drum, so that the sheet 23 is taken hold of by the suction drum 18. The sheet 23 is then decelerated, by means of the suction drum 18, to the lower circumferential speed u18, in the process covering a distance as far as the corresponding front marks on the processing cylinder 14. Since the instantaneous circumferential speed u18 of the sheet 23 is greater than the circumferential speed u14 of the processing cylinder 14, a beginning of the sheet 23 comes to butt against the front marks. As a result, the sheet 23 is again aligned in the circumferential direction, either the sheet 23 sliding on the suction drum 18 or else a shortening convexity being imparted to the sheet 23. Suction air is then applied to the suction strip 21 and in this way the sheet 23 is held in place. As a result, the spacing al between two successive sheets 23, 25 was reduced to a spacing a2. In the present example, the spacing a2 from the end of a leading sheet 23 to a beginning of a trailing sheet 25 on the processing cylinder 14 is approx. 4 mm.

At the same time, the substrate foil 49 is fed to the stamping cylinder 48 from the unwinding station. The substrate foil 49 extends, in the axial direction, not over the entire width of the sheet, but rather only narrow bands of substrate foil 49 are present in the region of the patterns which are to be applied. The sheet 23 is situated above the substrate foil 49. Substrate foil 49 and sheet 23 are then pressed by means of the pressure rolls 52, during rotation of the stamping cylinder 48, onto the heated stamping dies which are situated in the circumferential surface of the stamping cylinder 48. As a result, a pattern or picture which is arranged on the substrate foil 49 is applied to the sheet 23, 25.

After the beginning of the sheet 23 has left the last pressure roll 52, the suction air to the suction strip 21 is discontinued and, in order to detach the sheet 23 quickly, compressed air is briefly applied to the suction strip 21. The end of the sheet 23 is still clamped between stamping cylinder 48 and pressure roller 52, with the result that the beginning of the sheet 23 is pushed toward the first guide roller 29 of the conveyor belts 31. The substrate foil 49 beneath the conveyor belts 31 is guided along the path of the conveyor belts 31 from the first guide roller 29, over the cooling roller 32, to the second guide roller 33. In this process, the sheets 23, 25, which follow very closely together, are clamped between the substrate foil 49 and the conveyor belts 31. The sheets 23, 25 are thus guided from the guide roller 33, over the cooling roller 32, to the second guide roller 33. Downstream of the second guide roller, the substrate foil 49 is separated from the sheets 23, 25 by means of the foil-detachment device 51. The substrate foil 49 is fed to the winding-up station. The perforated conveyor belts 31 are fed over a suction box and suction air is thus applied to them. Downstream of the second guide roller 33, the sheets 23, 25 are sucked fixedly onto the conveyor belts 31 and, still at a short spacing apart, are conveyed to the suction drum 36 arranged upstream of the delivery 41. After the beginning of the sheet 23 covers the suction drum 36, suction air is applied to the latter, thus sucking the sheet 23 onto it. The suction air to the conveyor belts 31 is discontinued. The sheet 23 is then accelerated from the conveying speed v31 of the conveyor belts 31 to the conveying speed v44 of the gripper systems 44 of the delivery 41, i.e. in the present case to machine speed $u_m$. In so doing, the spacing a2 between two successive sheets 23, 25 is increased to a spacing a3, so that, for example, the spacing a3 between the end of the leading sheet 23 and the beginning of the trailing sheet 25 is 408 mm. The gripper system 44 then deposits the sheet 23 on the sheet pile 46 of the delivery 41.

In the present example, suction drums 18, 36 are used to change a first spacing al or a2 between leading sheet 23 and trailing sheet 25 to a second spacing a2 or a3. In this case, at least one of the two associated spacings a1, a2 or a2, a3 is variable.

These suction drums 18, 36 are in each case provided on their circumferential surface with a multiplicity of openings to which suction air can be applied. However, it is also possible to use conveyor devices 18, 36 in the form of drums which have one or more gripper systems or also in the form of gripper systems which carry out an oscillating movement ("swing feed" principle).

A length 123 of 472 mm of the sheet 23, with an average format length, in this exemplary embodiment results in the spacings a1 and a3 being 408 mm and the spacing a2 being 4 mm, while a minimum length 123 of 355 mm makes the spacings a1 and a3 524 mm.

| List of reference symbols | |
|---|---|
| 1 | Stream feeder |
| 2 | Creeper table |
| 3 | Sheet feed guide |
| 4 | Suction drum |
| 5 | — |
| 6 | Advance alignment mark |
| 7 | Side pull-type mark |
| 8 | Transfer drum |
| 9 | Drive (8) |
| 10 | — |
| 11 | Guide plate, first |
| 12 | Sheet-guidance roll |
| 13 | Guide plate, second |
| 14 | Processing cylinder |
| 15 | — |
| 16 | Partial piece (13) |
| 17 | Partial piece (13) |
| 18 | Suction drum, second |
| 19 | Drive (18) |
| 20 | — |
| 21 | Suction strip, holding system (14) |
| 22 | Circumferential surface (14) |
| 23 | Sheet |
| 24 | Bearing plate (14) |
| 25 | Sheet |
| 26 | Running rolls (24) |
| 27 | Guide |
| 28 | Drive, electric motor (14) |
| 29 | Guide roller, first |
| 30 | Guide plate |
| 31 | Conveyor belt |
| 32 | Cooling roller |
| 33 | Guide roller, second |
| 34 | Guide roller, third |
| 35 | — |
| 36 | Suction drum |
| 37 | Deflection roller |
| 38 | Guide roller, fourth |
| 39 | Drive (32) |
| 40 | — |
| 41 | Delivery |
| 42 | Guide plate |
| 43 | Chain (41) |
| 44 | Gripper system (41) |
| 45 | — |
| 46 | Sheet pile (41) |
| 47 | Drive (36) |
| 48 | Stamping cylinder |
| 49 | Foil |
| 50 | — |
| 51 | Foil-detachment device |
| 52 | Pressure roller |
| 53 | Pneumatic cylinder |
| 54 | Gripper system (8) |
| a1 | Spacing between two sheets (23; 25) |
| a2 | Spacing between two sheets (23; 25) |
| a3 | Spacing between two sheets (23; 25) |
| a44 | Spacing between the gripper systems (44) |
| b21 | Width of the suction strip (21) |
| D14 | Diameter of the processing cylinder (14) |
| u4 | Circumferential speed of the suction drum (4) |
| u8 | Circumferential speed of the transfer drum (8) |
| u14 | Circumferential speed of the processing cylinder (14) |
| u18 | Circumferential speed of the suction drum (18) |
| u18' | Circumferential speed of the suction drum (18) |
| u32 | Circumferential speed of the cooling roller (32) |
| u36 | Circumferential speed of the suction drum (36) |
| $u_m$ | Machine speed |
| 123 | Length of the sheet (23) |
| v31 | Conveying speed of the conveyor belts (31) |
| v44 | Conveying speed of the gripper systems (44) |

-continued

| List of reference symbols | |
|---|---|
| alpha | Angle |
| beta | Angle |

What is claimed is:

1. Device for conveying sheets (23; 25) in a sheet-processing machine with a processing cylinder (14) having a circumferential speed (u14) and with conveyor belts cooperating with said cylinder for transporting sheets and being arranged between the processing cylinder (14) and a chain conveyor with gripper system (44), wherein a ratio between the transportation speed (v31) of the conveyor belts (31) and the circumferential speed (u14) of the processing cylinder (14), i.e. v31/u14, can be changed by means of a drive of the conveyor belts in order to vary the distance between successive sheets.

2. Device as claimed in claim 1, wherein the processing cylinder (14) is arranged exchangeably and processing cylinders (14) of different diameters (D14) can be used, and wherein a transporting speed (v31) of the conveyor belts (31) is adjustable to a circumferential speed (v14) of the processing cylinder (14).

3. Device as claimed in claim 2, wherein a cooling cylinder (32) is arranged after the processing cylinder (14) and wherein the conveyor belts (31) are wrapped around the cooling cylinder (32) at least partially.

4. Device according to claims 1, 2 or 3, characterized in that as a drive for the conveyor belts (31) a dedicated speed-controllable electric motor is used.

5. Device according to claim 3, characterized in that the cooling roller (32) has a dedicated speed-controllable drive (39) and in that the conveyor belts (31) are frictionally driven by the cooling roller (32).

6. Device according to claims 1, 2 or 3, characterized in that the sheet processing machine is designed as a foil stamping machine and the processing cylinder (14) is designed as a foil stamping cylinder (48).

7. Method for conveying sheets (23; 25) wherein a band of foil (49) together with sheets (23, 25) are guided to a stamping cylinder (48) and away from said cylinder, wherein the band foil (49) is then guided with the sheets (23; 25) to conveyor belts (31), the sheets (23; 25) being between the band foil (49) and the conveyor belts (31) an wherein the band foil (49) and sheets (23; 25) are then guided to a cooling roller (32) by means of the conveyor belts (31).

8. Method as claimed in claim 7, characterized in that conveyor belts (31), foil (49) and sheets (23; 25) placed in-between are guided to a foilk-detachment device (51).

9. Method according to one of claims 7 or 8, characterized in that the sheets (23; 25) after detachment of the foil are guided to a transporting device (36) by means of the conveyor belts (31) and in that the transporting device (36) increases a spacing (a2) between the sheets (23; 25) to a spacing (a3).

10. Method according to claim 9, wherein the sheets (23; 25) are guided to a gripper system (44) of a chain conveyor by the transporting device (36).

* * * * *